US006375555B1

(12) United States Patent
Komata

(10) Patent No.: US 6,375,555 B1
(45) Date of Patent: Apr. 23, 2002

(54) VANE GROOVE GRINDING APPARATUS FOR COMPRESSOR CYLINDER

(75) Inventor: Kazuharu Komata, Ikeda (JP)

(73) Assignee: Daisho Seiki Corporation, Ikeda (JP)

( * ) Notice: Subject to any disclaimer, the term of this patent is extended or adjusted under 35 U.S.C. 154(b) by 22 days.

(21) Appl. No.: 09/626,386

(22) Filed: Jul. 26, 2000

(30) Foreign Application Priority Data

Mar. 28, 2000 (JP) ..... 2000-088619

(51) Int. Cl.[7] ..... B24B 15/03

(52) U.S. Cl. ..... 451/65; 451/57; 451/63; 451/119; 451/160; 451/162

(58) Field of Search ..... 451/65, 51, 63, 451/119, 160, 162, 259, 278, 280

(56) References Cited

U.S. PATENT DOCUMENTS 4,625,465 A * 12/1986 Kirt ..... 451/51
5,171,112 A * 12/1992 Roland ..... 409/81
5,690,541 A * 11/1997 Dalke ..... 451/63

FOREIGN PATENT DOCUMENTS

JP 03-75232 * 3/1991 ..... 451/51
JP 05-269654 * 10/1993 ..... 451/51

* cited by examiner

*Primary Examiner*—George Nguyen
(74) *Attorney, Agent, or Firm*—Crowell & Moring LLP

(57) ABSTRACT

A vane groove grinding apparatus for compressor cylinder including a compressor cylinder holding means the compressor cylinder being provided with an inner hole and a vane groove extending radially outwardly from the inner hole, sliders being movable along a center line of the inner hole and at a right angled direction to the vane groove, a grinding disk holder facing one open side of the inner hole and a support for locking the holder facing another open side of the inner hole both being disposed on a slider adjacent to the compressor cylinder, when the grinding disk is inserted in the vane groove a distal end of the grinding disk holder is firmly engaged in the support.

4 Claims, 8 Drawing Sheets

VANE GROOVE GRINDING APPARATUS FOR COMPRESSOR CYLINDER

BACKGROUND OF THE INVENTION

This invention relates to a vane groove grinding apparatus for a compressor cylinder containings an inner hole and a vane groove extending radially outwardly from the inner hole.

FIG. 8 is a perspective view showing a conventional vane groove grinding apparatus in which a compressor cylinder 1 held in the shown position by a holding means (not shown) has an inner hole 2 (center line: O1) and a vane groove 3 extending radially outwardly from the inner hole. In the inner hole 2, a holder 5 and a thin cylindrical inside grinder 6 are inserted, the holder 5 being attached on the left end of a grinding apparatus, a right end of the grinder 6 being connected to a spindle 7 and the left end of the grinder 6 being rotationally received by the holder 5. While keeping the grinder 6 in high speed rotation by the spindle 7, when the body 4 is driven in the direction of arrow X1 together with the grinder 6, the grinder 6 grinds one surface of the opposing surfaces of the groove 3, and when the body 4 is driven in the reverse direction from arrow X1, the grinder 6 grinds another surface of the opposing surfaces of the groove 3. 8 is an open space. Generally in the vane type compressor, the cylinder 1 is covered by side housings from both sides, and a rectangular vane plate in the groove 3 contacts on the outer surface of an eccentric rotor (not shown).

But, according to the above grinding system, abrasion on the grinder 6 differs at places of different distances from its proximal end, which causes the deterioration of plane degree (accuracy) and parallel degree (accuracy) of the opposing surfaces of the groove 3. In addition, due to the small diameter of the grinder 6, its grinding speed on the surface and its rigidity are inevitably low, these disadvantages increase as the width of the groove gets small.

In a disk grinding system shown in FIG. 9, a grinding disk 10 supported by a bar-shaped holder 9 and driven in the direction of arrow X2 by way of a drive force transmitting means installed inside the holder 9, grinds one surface of the opposing surfaces of the groove 3 when the holder 9 moves to the left in the direction of arrow X2, and grinds another surface of the groove 3 when the holder 9 returns in the reverse direction to the position of FIG. 9.

But, according to the grinding system of FIG. 9, since the projecting distance of the holder 9 varies as the grinding process proceeds and the holder 9 is a cantilever the plane degree and parallel degree of the opposing surfaces of the groove 3 are inevitably unstable. In addition, it is difficult to change the grinding disk, in that it is necessary to change the grinding disk 10, belts, bearings and the like.

SUMMARY OF THE INVENTION

An object of this invention is to improve manufacturing accuracy, especially for plane degree and parallel degree, and manufacturing efficiency. A first embodiment is a vane groove grinding apparatus for a compressor cylinder comprising a compressor cylinder holding means, the compressor cylinder being provided with an inner hole and a vane groove extending radially outwardly from the inner hole, sliders being movable along a center line of the inner hole and along a right angled direction to the vane groove, a grinding disk holder facing one open side of the inner hole and a support for locking said holder facing another open side of the inner hole both being disposed on a slider adjacent to the compressor cylinder, when the grinding disk is inserted in the vane groove a distal end of the grinding disk holder is firmly engaged in the support.

A second embodiment is a vane groove grinding apparatus as described above, in which the compressor cylinder holding means is an index table being provided with a plurality of working stations at regular intervals with clampers.

A third embodiment is a vane groove grinding apparatus of the type of the first embodiment, in which one of the engaging portions of the holder and support is a wedge shaped projection and another portion is a wedge shaped slot.

A fourth embodiment is a vane groove grinding apparatus of the type of the first embodiment, in which the sliders are composed with combined plural sliders.

DETAILED DESCRIPTION OF THE PREFERRED EMBODIMENTS

Figure 1:
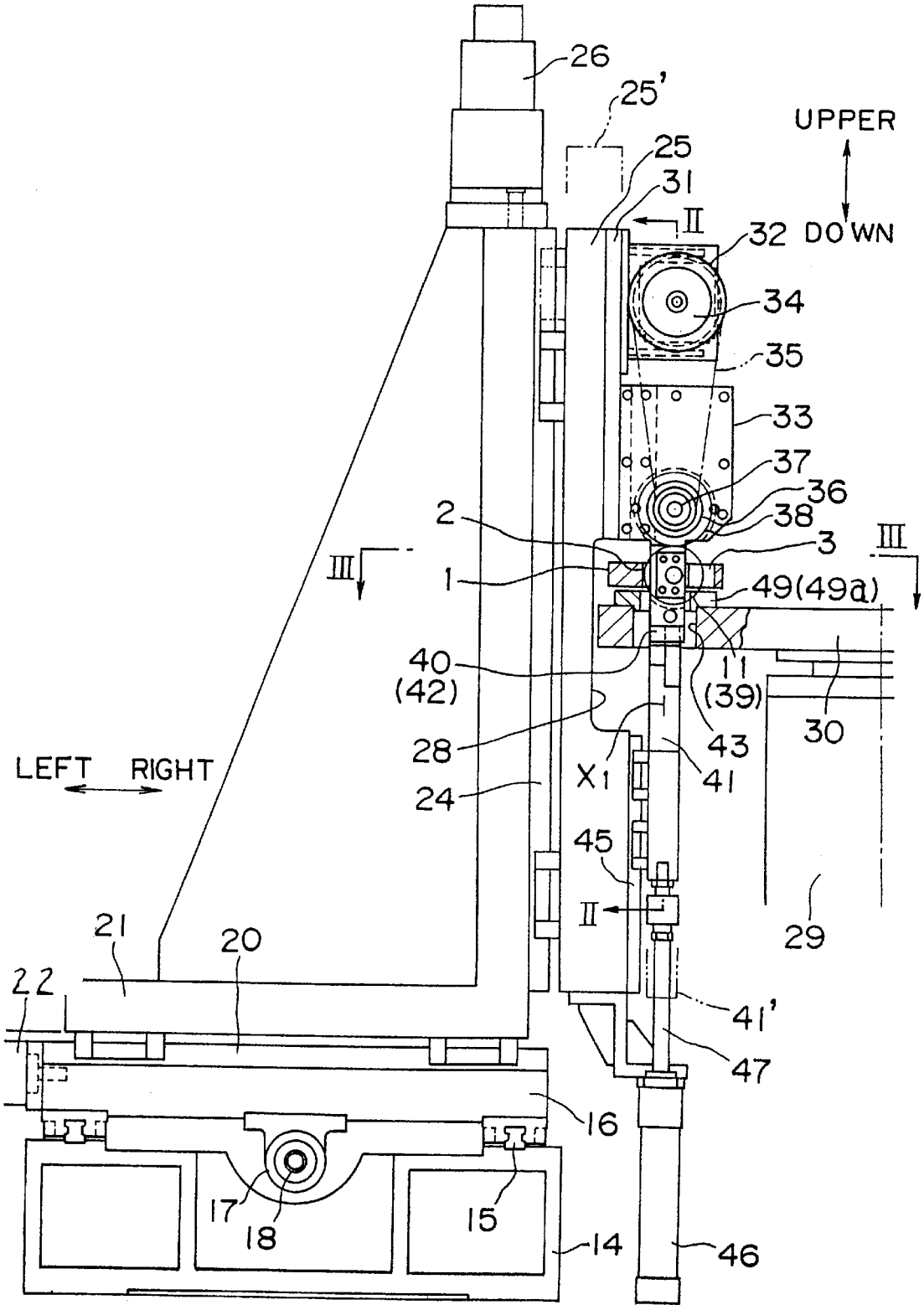
FIG. 1 is a partially sectional elevational view of the inventive vane grinding apparatus during the grinding operation.
Figure 2:
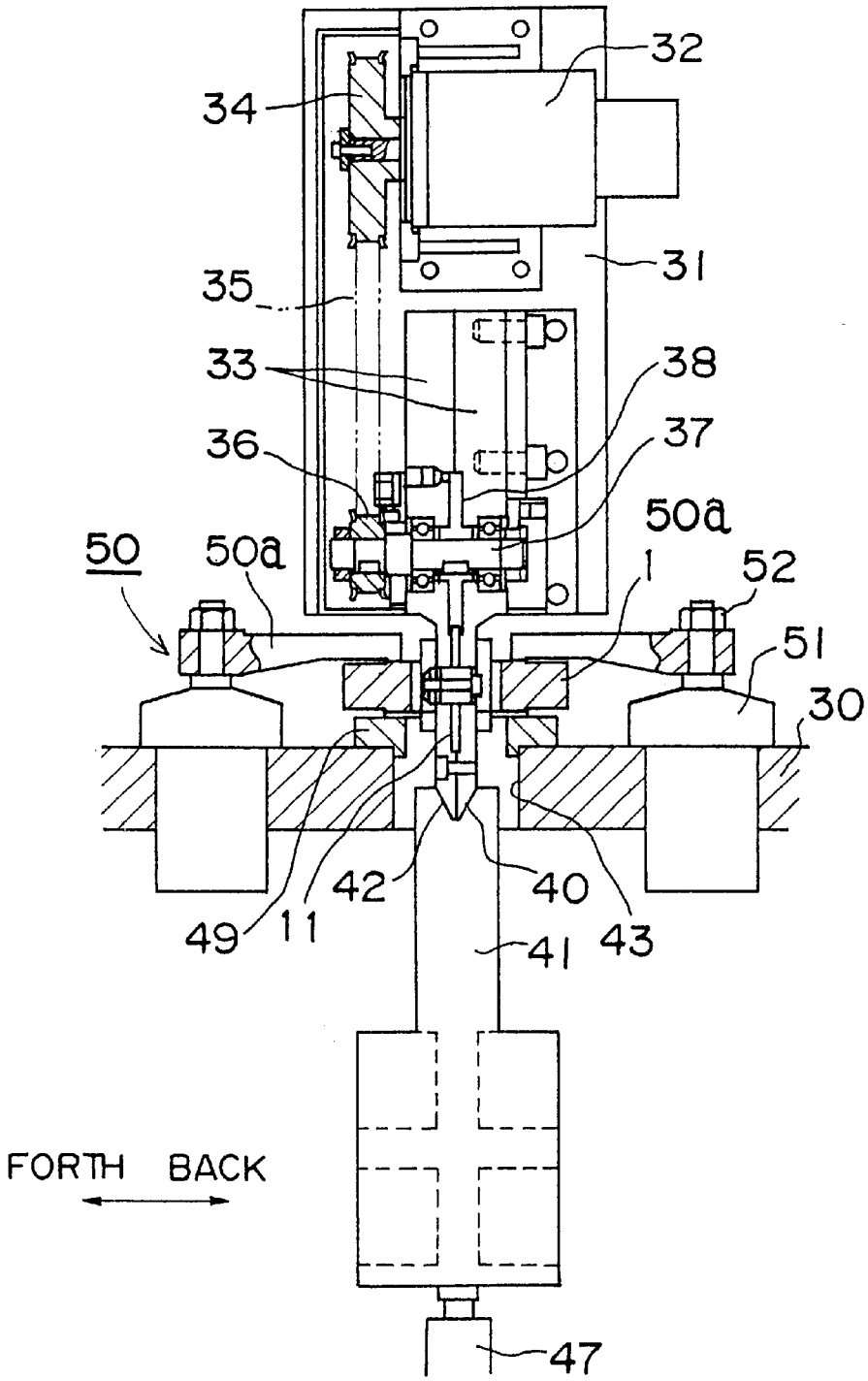
FIG. 2 is a schematic sectional view taken on the line II—II of FIG. 1.
Figure 3:
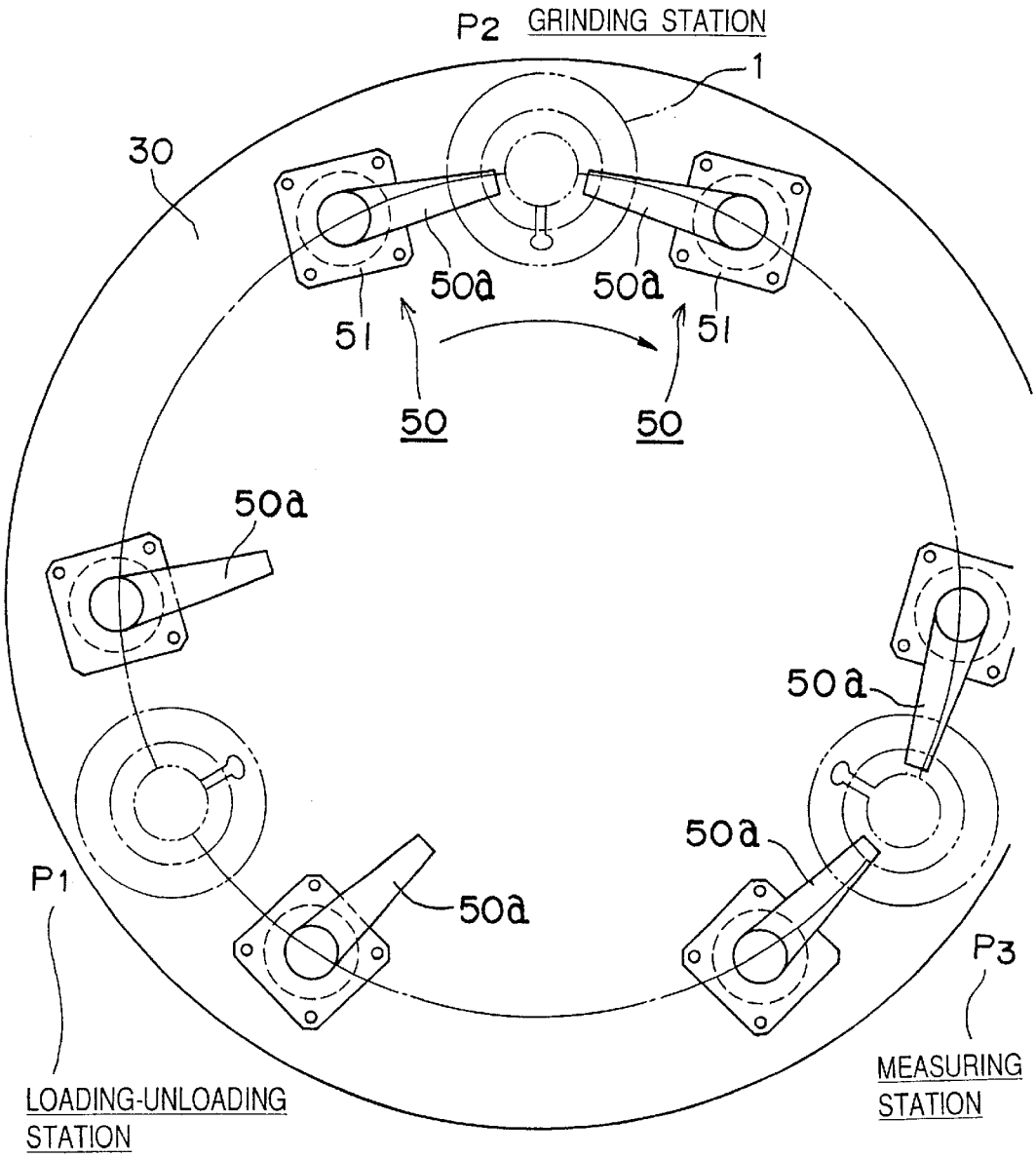
FIG. 3 is a schematic sectional view taken on the line III—III of FIG. 1.
Figure 8:
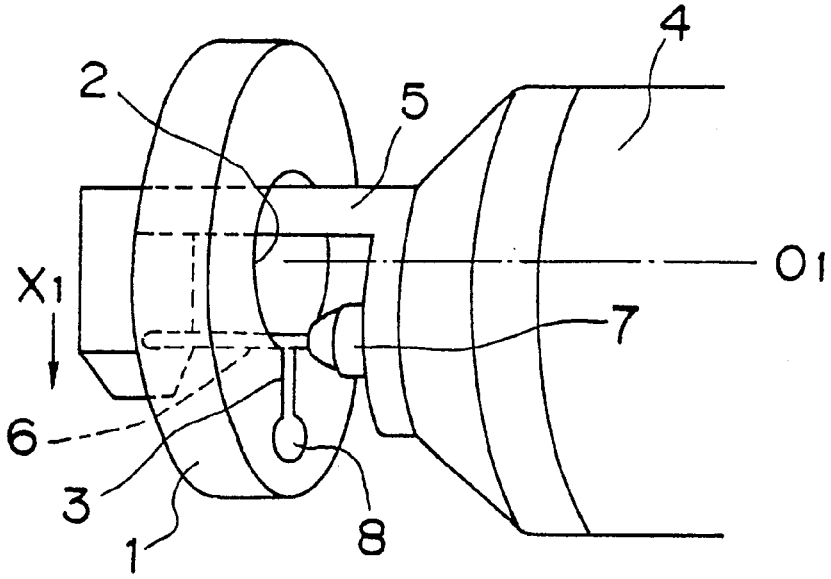
Fig.8 PRIOR ART
FIG. 8 is a perspective view showing a prior art construction.
Figure 9:
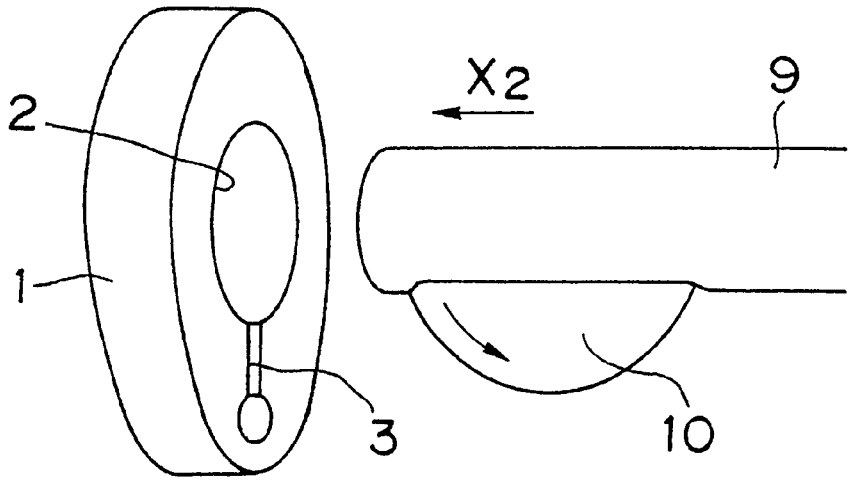
Fig.9 PRIOR ART
FIG. 9 is a perspective view showing another prior art construction.

In FIGS. 1~3 showing the first embodiment of the present invention, like member as in FIG. 8 and FIG. 9 show like or corresponding elements. On a base 14 in FIG. 1, a back-and-forth slider 16 is supported through a rail 15 extending back-and-forth direction, i.e. at a right angle to the paper of FIG. 1. A female screw thread 17 supported on the under surface of the back-and-forth slider 16 is threadedly engaged with a lead screw 18 through balls (forming a ball screw) the lead screw 18 being connected to an output shaft of an AC servomotor (both not shown) attached to the base 14. Therefore, by driving the back-and-forth slider 16 back-and-forth i.e. in a direction at right angles to the paper of FIG. 1, a grinding disk 11 moves to the surfaces of the vane groove 3 at a right angle, which permits a predetermined depth of cut to the opposite surfaces of the vane groove 3.

On the back-and-forth slider 16, a right-left slider 21 is supported through a rail 20, and the right-left slider 21 is Connected to an AC servomotor 22 through another ball screw mechanism (not shown) to move right and left, the AC servomotor 22 being attached to the back-and-forth slider 16.

An up-and-down slider 25 is supported on a vertical rail 24 of the right-left slider 21, the up-and-down slider 25 being connected to an AC servomotor 26 through another ball screw mechanism (not shown) to move up-and-down, the AC servomotor 26 being mounted on top of the right-left slider 21.

In an indented portion 28 formed on the right hand side surface middle part of the up-and-down slider 25, a left end part of an index table 30 of an index machine 29 enters in. A base 31 is mounted on the right hand side surface of the up-and-down slider 25 above the indented portion 28, and the base 31 is provided with a motor 32 and a grinding disk holder 33, an output pulley 34 of the motor 32 being connected to a pulley 36 through a timing belt 35, a gear 38 fixed on an axle 37 also fixed on the pulley 36 being meshed with a gear 39 (see FIG. 5) formed outside the periphery of the grinding disk 11. Two wedge shaped projections 40 formed on the lowest ends of the holders 33 are engaged with a wedge shaped concave slot formed on the top end of the support 41, the engaged point being inside a hole 43 formed in the index table 30.

The support 41 is guided to move up and down on a vertical rail 45 attached to the right hand side surface of the up-and-down slider 25, a lowest end of the support 41 being connected to a rod 47 of an oil hydraulic cylinder 46 attached to the up-and-down slider 25.

In an upper periphery of the hole 43 of the index table 30, a C shaped spacer ring 49 is engaged with its slit 49*a* to be oriented to the right in FIG. 1 (i.e. to the side of the center of the index table 30). On the spacer ring 49, the cylinder 1 is disposed with its vane groove 3 located just on the slit 49*a*, and the cylinder 1 is clamped by a pair of arms 50*a* of a damper 50 (an example of holding means). As the vane groove 3 of the cylinder 1 is located near the side of table center from the hole 43, a moment to the index table 30 due to the grinding force acting at a right angle on one of the opposed surfaces of the vane groove 3 during the grinding process decreases, which makes it easy to keep the index table 30 stationary and firmly, and to increase the manufacturing accuracy. In FIG. 2, 51 is an oil hydraulic (clamping) cylinder fixed on the index table 30, and 52 is a clamping nut engaged on top of the rod projecting upward from the cylinder 51. On the index table 30, as shown in FIG. 3, there are working stations such as a loading-unloading station P1, a grinding station P2 and a measuring station P3 indexed on a circle at regular intervals. When a workpeice is clamped, arms 50*a* directing to the table center as shown in the loading station P1 in FIG. 3 are rotated to the direction of the center of the cylinder as shown in the grinding station P2, then forced downward to clamp the work (cylinder 1). When a work is unclamped, arms 50*a* positioned on a circle as shown in measuring station P3 are forced upward to unclamp and are rotated to direct the center of the index table 30 as shown in the unloading station P1.

Figure 4:
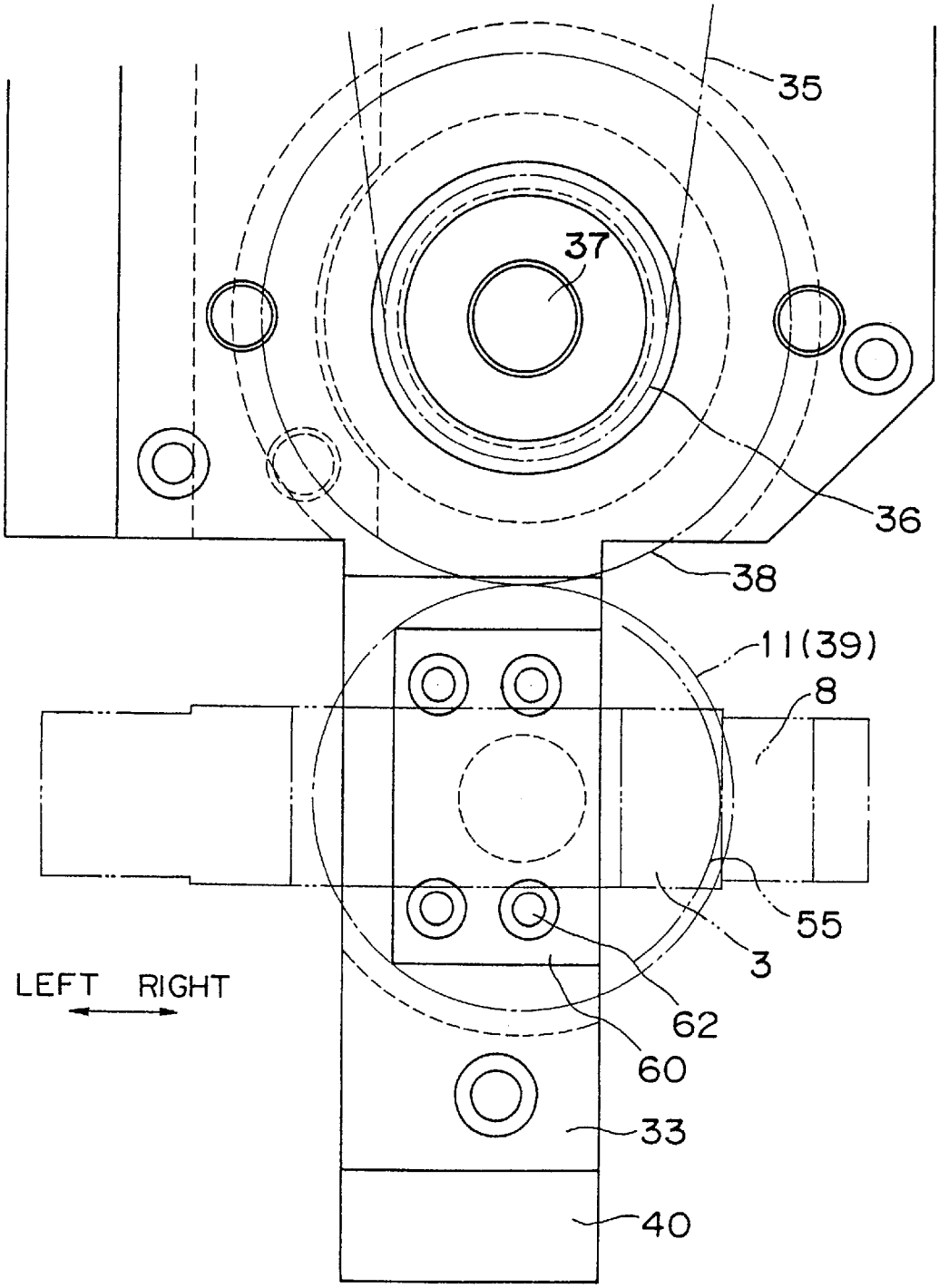
FIG. 4 is a partially enlarged view of FIG. 1.
Figure 5:
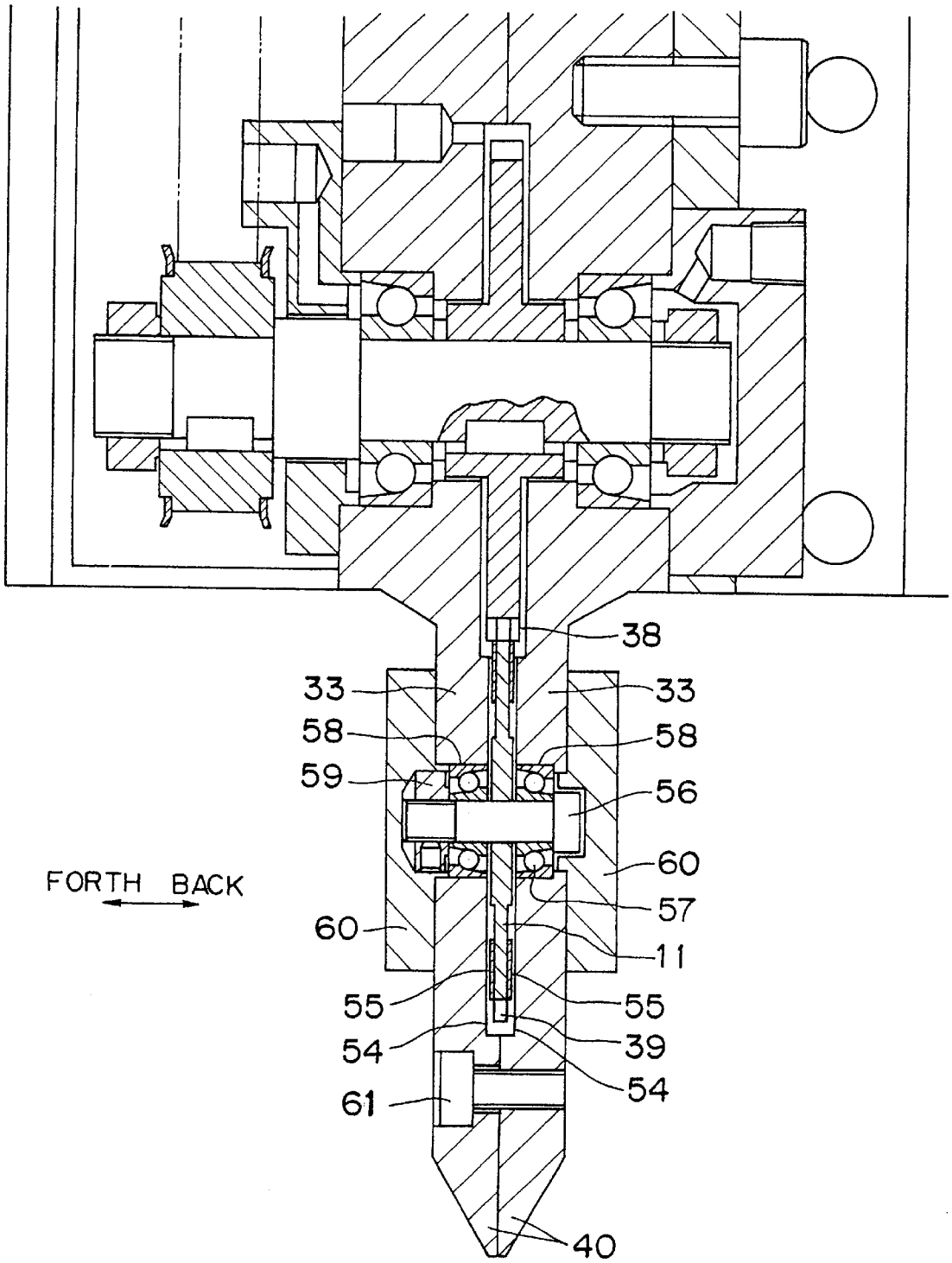
FIG. 5 is a partially enlarged view of FIG. 2.
Figure 6:
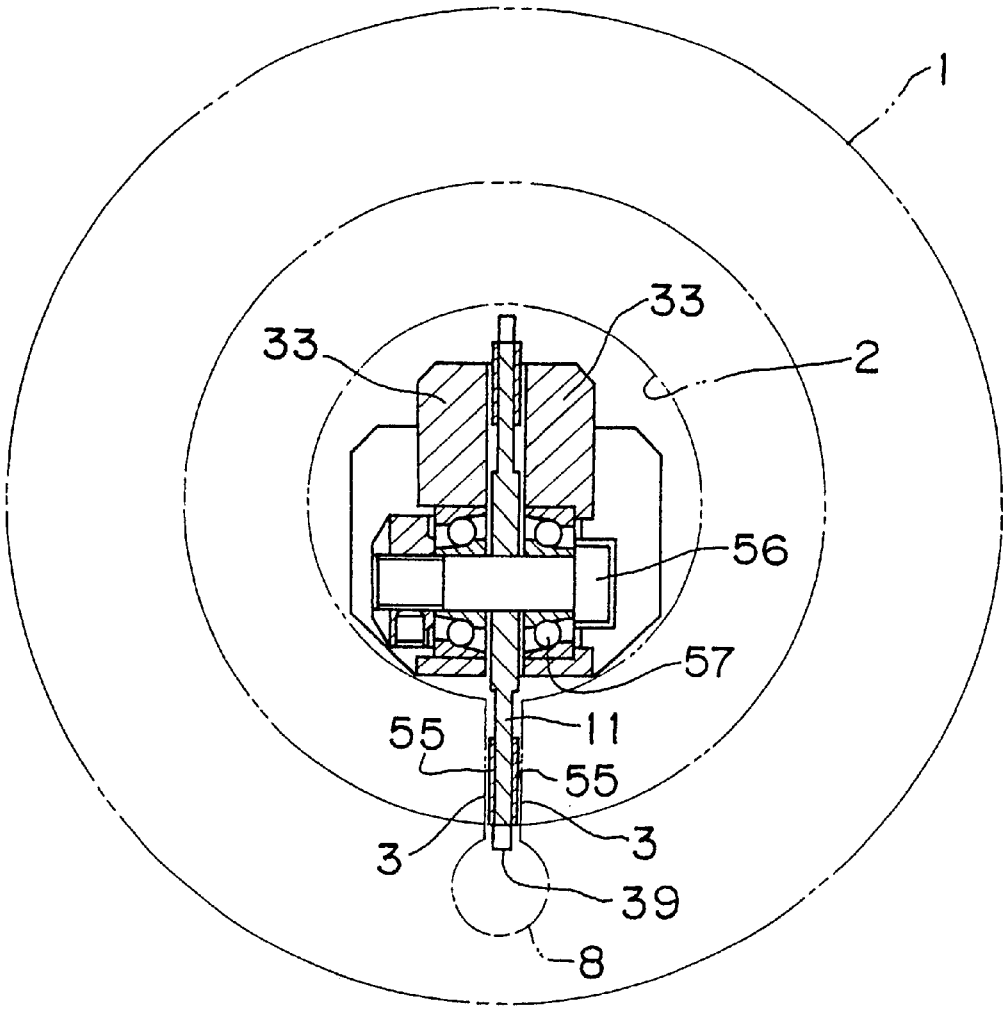
FIG. 6 is a partially enlarged view of FIG. 3.

FIGS. 4, 5, 6 are partially enlarged views of FIGS. 1, 2, 3 respectively. As clearly shown in the FIG. 5, the grinding disk 11 is formed of a circular steel plate with a gear 39 on the periphery and grinding layers 55 (membrane, thin plate etc.) such as CBN on both sides. A central axle bolt 56 is supported in holes 58 of halved holders 33 through a bearing 57. The grinding layers 55 are opposed to indented portions 54 through slight clearances. 59 is a nut, 60,60 are covers and 61 is a bolt. As shown in FIG. 4, the grinding disk 11 is mounted as exposed more to the right from the holder 33, by which the grinding layers 55 of the grinding disk 11 are able to cover or grind each of the whole opposed surfaces of the vane groove 3 while moving up and down, and allow the gear 39 to project in the open space 8.

Although FIG. 1 shows the state of the grinding operation going on, prior to the grinding operation, the support 41 is lowered to the position 41', the up-and-down slider 25 is raised to the position 25', thus-keeping the support 41 below the hole 43, as well as the holder 33 above the inner hole 2 and above the damper 50, rotating the index table 30 to the arrow as shown in the FIG. 3 and indexing a non ground cylinder 1 to the grinding station P2. Then the right left position of the right-left slider 21 is fixed as the grinding disk 11 to take the position of FIG. 1 or FIG. 6. The motor 32 is kept running. As the holder 33 is lowered, the support 41 is raised which causes the wedge shaped projections 40 being engaged with the wedge shaped slot 42 as shown in FIG. 1. The up-and-down slider 25 repeats up and down motion giving gradual cut to one of the opposed surfaces of the vane groove 3 by the back-and-forth slider 16, and when a determined cut is given, the other surface is ground in the same way. When the grinding operation ends, the slider 25 is raised to 25', the support 41 is lowered to 41', and the index table 30 is rotated to the arrow of FIG. 3 by 120 degrees keeping the cylinder 1 free from the up-and-down slider 25 and support 41. By that time, loading and unloading are finished at the station P1, and measuring is finished at the station P3.

Figure 7A:
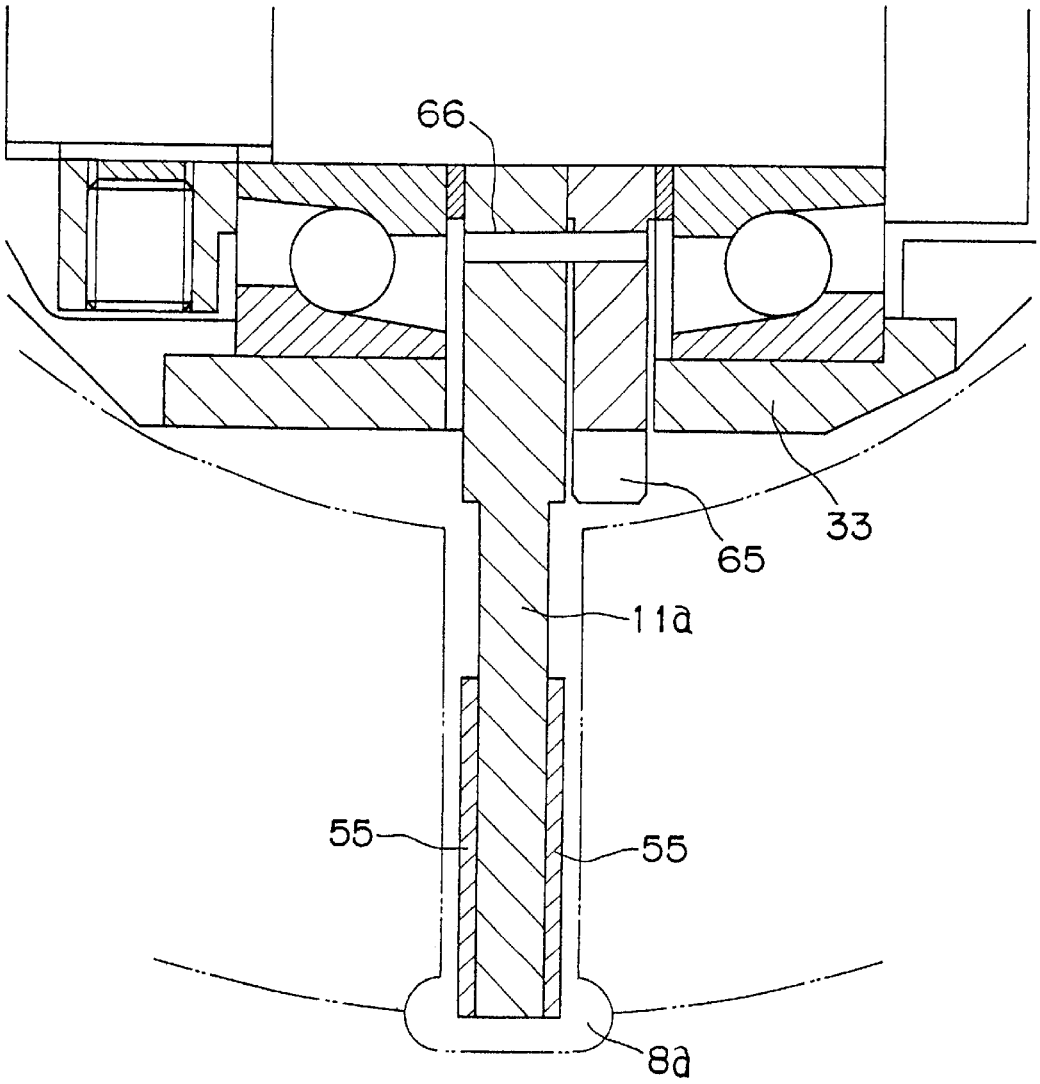
FIG. 7A, FIG. 7B and FIG. 7C are views corresponding to a part of FIG. 5 to show various modified constructions.

As shown in the FIG. 7A, in case a radial depth of an open space 8a is small and it is difficult to provide a gear 39 on a grinding disk as shown in FIG. 1 and FIG. 5, a grinding disk 11*a* without a gear and an adjacent gear 65 may be combined in a body by spring pins 66 for example, the gear 65 being driven by way of an idle gear (not shown) which is supported in the holders 33. According to the construction, the grinding disk 11*a* which needs repair exchange periodically becomes simple in structure to avoid or decrease the exchange, and presents a lower operation cost.

Figure 7B:
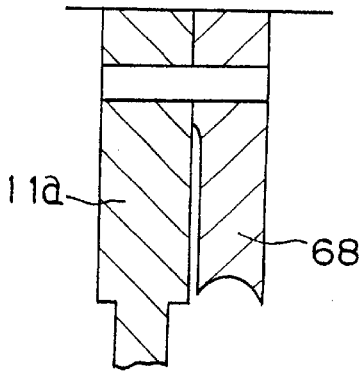

Instead of the gear 65, a pulley 68 (FIG. 7B) may be employed and the pulley 68 may be driven by a belt with a circular cross section, a timing belt or the like. In that case, the same effect as in FIG. 7A may be expected.

Figure 7C:
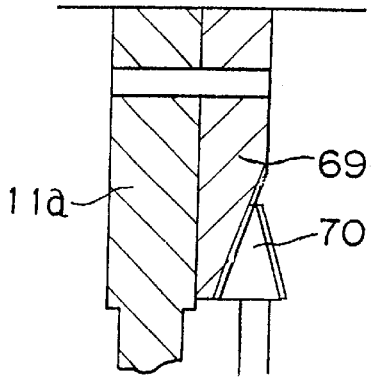

In place of a pulley 68, a bevel gear 69 (FIG. 7C) may be employed and the bevel gear 69 is engaged with a bevel pinion 70 which is supported by holders 33, the bevel pinion 70 being driven through a cable (not shown). In this case, the driving mechanism gets compact and the manufacturing cost decreases.

Besides, in place of the wedge shaped projections 40 and wedge shaped slot 42, a conical projection and a conical indented portion may be employed. According to that variation, a binding of the right-and-left direction is accomplished as well as a binding of the to-and-fro direction, resulting in a high manufacturing accuracy and lower manufacturing cost. On the other hand, the wedge shaped projection 40 and the wedge shaped slot as shown assures a position holding rigidity of the to-and-fro direction of the grinding disk 11, 11*a*, and accurate distance, parallel degree and plane degree of the opposing surfaces of the vane groove 3. The halved holders 33,33 shown in FIGS. 2 and 5 assure simple assembling.

According to the first embodiment, since the lowest end of the holder 33 is firmly confined by the support 41 while the vane groove 3 is ground by the reciprocating up-and-down slider 25, i.e. the grinding disk 11 is supported at both upper and lower sides not like a cantilever, a stable support is accomplished improving the plain degree and parallel degree of the vane groove surfaces great deal.

According to the second embodiment, an accurate working position is provided and a high grinding efficiency is expected.

According to the third embodiment, the lower end of the holder 33 is firmly bound by the support 41.

According to the fourth embodiment, back-and-forth, right-and-left, up-and-down movements of the grinding disk 11 get stable and easy, and guiding mechanisms also get simple.

What is claimed is:

1. A vane groove grinding apparatus for a compressor cylinder having an inner hole and a vane groove extending radially outwardly from the inner hole, said apparatus comprising a compressor cylinder holding means, a first slider being movable along a center line of the inner hole, a second slider being movable along a right angle direction to the vane groove, a grinding disk holder facing one open side of the inner hole and a support for locking said holder facing another open side of the inner hole both being disposed on a third slider adjacent to the compressor cylinder, and when the grinding disk is inserted in the vane groove a distal end of the grinding disk holder is firmly engaged in the support.

2. A vane groove grinding apparatus according to claim 1, in which the compressor cylinder holding means is an index table being provided with plurality of working stations at regular intervals with clampers.

3. A vane groove grinding apparatus according to claim 1, in which one of the engaging portions of the holder and support is a wedge shaped projection and another portion is a wedge shaped slot.

4. A vane groove grinding apparatus according to claim 1, in which the sliders are composed with combined plural sliders.

* * * * *